US005184507A

United States Patent [19]

Drake

[11] Patent Number: 5,184,507

[45] Date of Patent: Feb. 9, 1993

[54] SURFACE HYDRAULIC PUMP/WELL PERFORMANCE ANALYSIS METHOD

[75] Inventor: Charles L. Drake, Bakersfield, Calif.

[73] Assignee: Union Oil Company of California, Los Angeles, Calif.

[21] Appl. No.: 633,243

[22] Filed: Dec. 21, 1990

[51] Int. Cl.[5] ..... E21B 47/00

[52] U.S. Cl. ..... 73/151

[58] Field of Search ..... 73/155, 151; 166/250, 166/68.5

[56] References Cited

U.S. PATENT DOCUMENTS 3,343,409 9/1967 Gibbs ..... 73/151

OTHER PUBLICATIONS

"Subsurface Hydraulic Pumping Diagnostic Techniques", by Nolen and Gibbs, published by the Society of Petroleum Engineers, SPE 4540, 1973.

"A Review of Methods for Design and Analysis of Rod Pumping Installation", Gibbs, SPE 9980, 1982.

"Surface Hydraulic Rod Pumping Systems", Drawing, Phoenix Hydraulic Pumping System.

"Onsite Analysis of Sucker Rod Pumping Wells", by Kramer et al., published by Society of Petroleum Engineers, SPE 11037, 1982.

*Primary Examiner*—Hezron E. Williams
*Assistant Examiner*—Michael Brock
*Attorney, Agent, or Firm*—Gregory F. Wirzbicki; William O. Jacobson

[57] ABSTRACT

Surface hydraulic fluid pressure and sucker rod displacement are measured and used to analyze the performance of a pumped oil well having a surface hydraulic actuator connected to a downhole pump by the sucker rod. The pressurized hydraulic fluid actuates a cyclic motion of the rod and a pumping of the oil. The measured rod motion and hydraulic fluid pressure are used together with an added flexible rod simulator to calculate a performance characteristic. The analysis method accounts for rod interactions with the hydraulic actuator and hydraulic pump. The present invention avoids installation of a load cell and disassembly/shutting down the operating pumping unit as is required by the conventional rocker beam analysis methods. The present invention also avoids flow measurements, as is required by conventional subsurface hydraulic motor and analysis methods, and complex dynamic frictional fluid loss analysis.

23 Claims, 2 Drawing Sheets

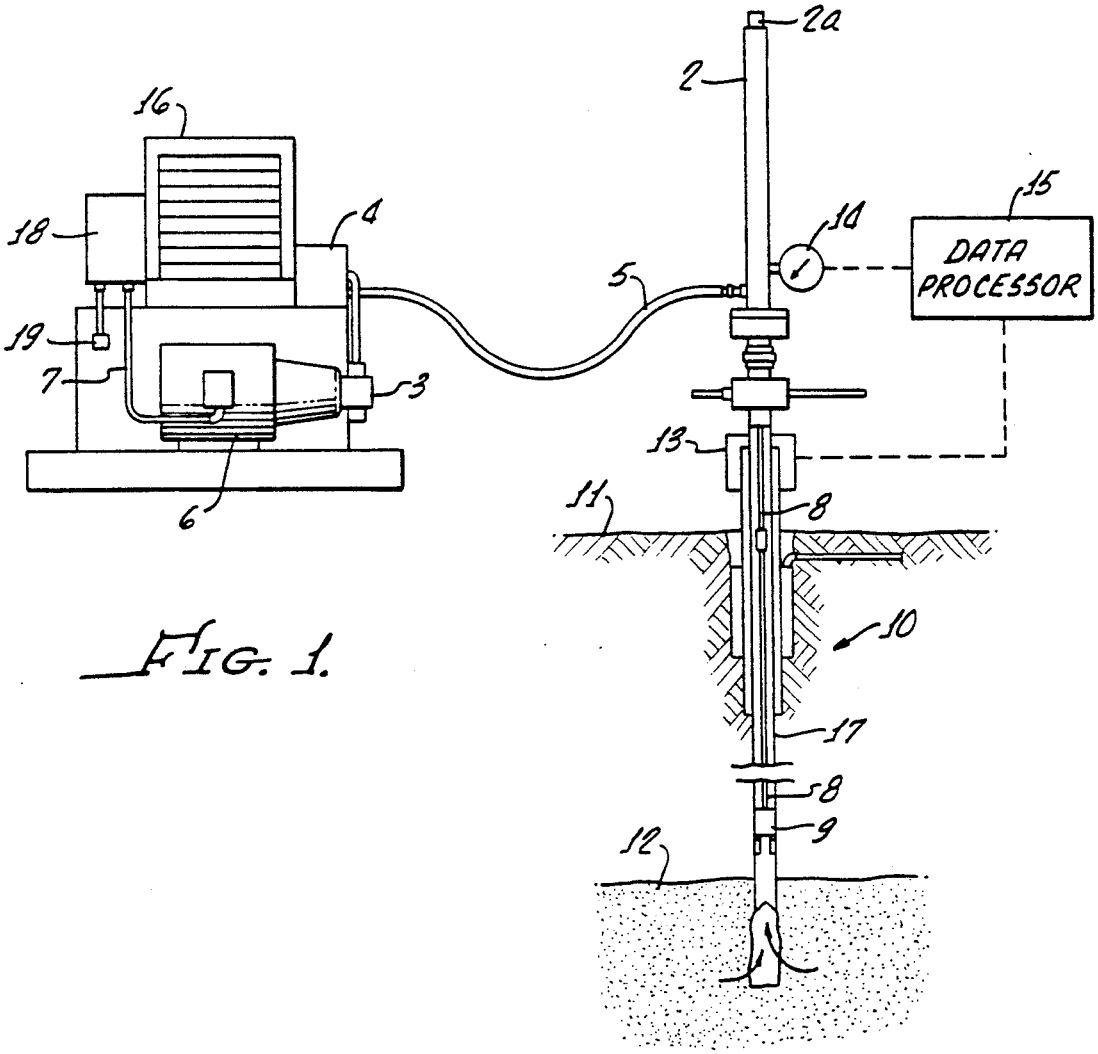
FIG. 1.
FIG. 2.
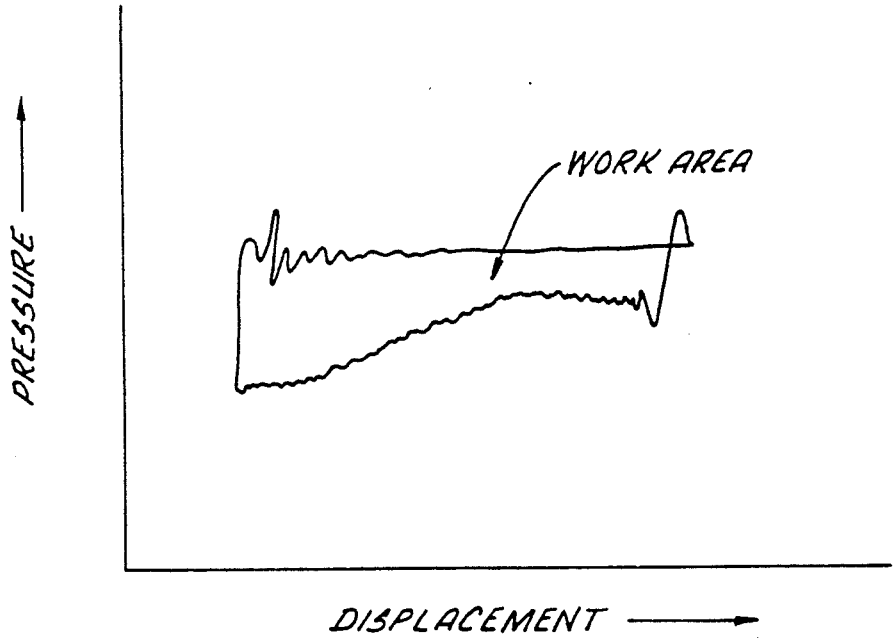

SURFACE HYDRAULIC PUMP/WELL PERFORMANCE ANALYSIS METHOD

FIELD OF THE INVENTION

This invention relates to the hydraulically pumped wells and methods for evaluating the performance of such wells. More specifically, the invention is concerned with oil wells having a surface hydraulic pumping unit connected by a "sucker rod" to a subsurface plunger within a pump, and methods to evaluate the performance of this "floating" sucker rod system.

BACKGROUND OF THE INVENTION

Many conventionally pumped or "artificial lift" oil wells use a downhole reciprocating plunger type of pump. The reciprocating downhole pump assembly is relatively long and thin to avoid restricting oil flow up the well and is typically actuated by a longer and thinner "sucker rod" extending to the surface. The surface end of the sucker rod is pivotally attached to a rocking beam drive unit.

Beam units are typically driven by counterweighted flywheels connected to electric motors or internal combustion engines. The beam units occupy a relatively large surface area when compared to the diameter of the sucker rod, pump, or wellhead. Beam units are also very heavy for some applications, raising concerns such as containing heavy rotating mass and adequacy of supports.

For other pumped well applications, special downhole or subsurface motors (e.g., small diameter reciprocating hydraulic actuators supplied by tubing connected to surface sources of pressurized hydraulic fluid) are directly coupled to the subsurface pump. Subsurface motor geometries are constrained by the available room within the well diameter and production fluid flow requirements. Because of these constraints, subsurface pumps are more common on large diameter, deep wells.

Although surface rocking beam and subsurface hydraulic motor devices are common for many pumped well applications, these devices cannot be used economically for all pumped well applications. In certain applications, such as an offshore platform having multiple conventional diameter wells, have no room for large footprint beam units and subsurface hydraulic pumps would unduly restrict oil production from these diameter wells. These applications can use sucker rod actuated resource fluid pumps, but each rod is activated by a small footprint surface hydraulic actuator and a pumping unit instead of larger and heavier beam units. These surface hydraulic actuator and pumping units have been used successfully for many years.

Methods and instrumentation to evaluate the performance of both surface beam driven and subsurface motor driven pumped well systems have been developed. In a standard API method for evaluating sucker rod system performance, the production system is first shut down to install a load cell (a displacement transducer typically already exists) on the sucker rod and then restarted to produce a dynamometer card. The dynamometer card is a cyclic graph of cyclic sucker rod tensile forces and displacements (as measured at the polished rod atop the wellhead and extrapolated or normalized for various conditions such as downhole pump depth, sucker rod properties, beam unit characteristics, motor power, pump speed, and production fluid pressure and flow data). Dynamometer cards are compared and correlated to standardized API cards to evaluate system performance. Standardized API cards show various normal performance and performance problem indications. A microprocessor can be employed to calculate, normalize, compare, store, and otherwise process the data.

Conventional on-site performance analysis of subsurface motor driven units also relies primarily upon surface measurements, but the primary measurements are now hydraulic fluid pressure and flow. These measurements are derived from surface pressure and flow transducers and are similarly combined with other surface measurements (e.g., production fluid pressure and flow) and constants (e.g., fluid and sucker rod properties) to extrapolate and evaluate downhole pump and well performance. Evaluation again involves comparison of data (which may be normalized) to known performance indications. A microprocessor can again be employed to process the data.

Both surface beam and subsurface hydraulic motor well performance analysis methods primarily rely on surface measurements which are extrapolated to subsurface conditions. Although downhole measurements would avoid these extrapolations, downhole measurements are costly. Still further, downhole transducers are also susceptible to malfunction and errors which may be caused by high downhole pressures and temperatures.

However, when surface hydraulic actuators and pumping units are monitored by performance analysis methods relying primarily on surface measurements, problems have been experienced. A major problem with sucker rod (force/displacement) analysis is access to the sucker rod. The actuator may not allow installation of a load cell without a costly disassembly. A problem with both conventional sucker rod dynamometer (force/ displacement plots) cards and hydraulic fluid pressure/flow graphs is extraneous perturbations. The perturbations do not appear to be correlatable to known pump or well performance indications on either type of analysis.

None of the conventional approaches known to the inventor avoids perturbation problems when evaluating the performance of a well using a surface mounted hydraulic actuator and pumping unit connected by a sucker rod to a downhole pump. Standard comparisons to API plots also do not appear to be as cost effective or reliable a method for analyzing surface hydraulic actuator pumped well performance as for analyzing a beam driven unit.

SUMMARY OF THE INVENTION

Such performance indication problems are avoided in the present invention by a) measuring surface hydraulic fluid pressure (instead of conventional hydraulic fluid pressure and flow or force and rod displacement measurement) and b) providing a "floating" rod simulator program to analyze downhole pumped well performance. The present invention avoids access to (and shutting down) of an operating sucker rod to install a load cell or force transducer (as required by conventional sucker rod performance analysis methods). The present invention also avoids hydraulic fluid flow measurements and complex dynamic frictional fluid loss analysis and extrapolations.

Instead, the present invention is a method for determining a performance characteristic of a pumped oil well having an actuator located at the ground surface primarily using hydraulic fluid pressure. The method measures pressurized fluid (causing a cyclic motion of the rod and a pumping of the oil) during at least one cyclic period, and calculating a performance characteristic based at least in part upon measured actuating fluid pressure. The measured pressures during a cycle can be used to calculate sucker rod motion or the motion can be directly measured. The pressure and sucker rod motion is then output and compared to known performance outputs.

BRIEF DESCRIPTION OF THE DRAWINGS

FIG. 1 shows a schematic view of a surface hydraulic pumping unit, sucker rod, and subsurface pump, and a well performance data collection system;

FIG. 2 shows a sample dynamometer plot; and

In these Figures, it is to be understood that like reference numerals refer to like elements or features.

DETAILED DESCRIPTION OF THE INVENTION

Figure 3:
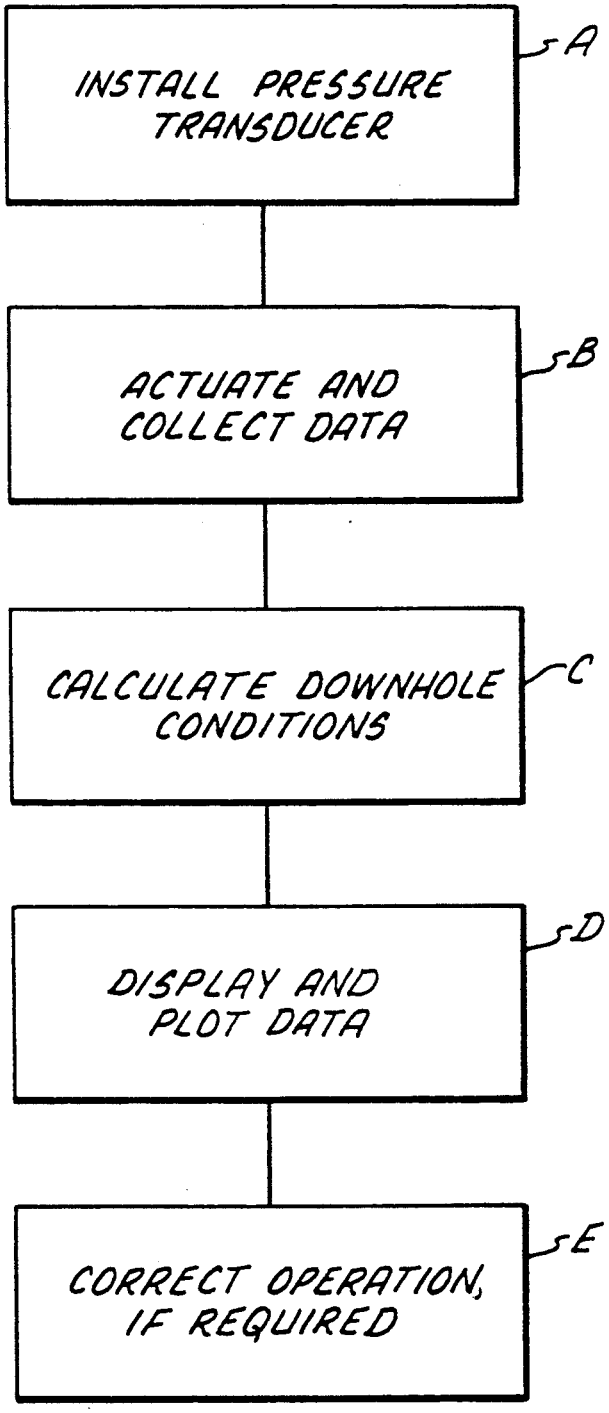
FIG. 3 shows a process flow diagram.

The problem of extraneous perturbations in conventional performance analysis data appears to be caused by the inherent flexibility and mass of a long sucker rod "floating" between two fluid filled cylinders. This flexibility and lack of solid support at either end of the rod allow sucker rod motions which affect both the surface hydraulic fluid pressures as well as the downhole reservoir and pump pressures. These motions show as perturbations on conventional performance analysis indicators. The perturbations can also create errors in conventional extrapolations to downhole conditions.

Conventional well analysis methods (for beam units attached to a sucker rod) generally assume that a solid rocker beam is pivotally or sling attached to a rotor. The beam geometry (and the attached sucker rod end) is assumed to be essentially unaffected by sucker rod flexibility or downhole pump conditions. Similarly, conventional subsurface motor analysis methods assume that the downhole hydraulic motor and downhole pump are directly coupled.

The discovery that significant new rod motions are possible in this "floating" (i.e., unattached to a solid beam) rod configuration has led to analysis and testing which have confirmed that the previously unexplained extraneous perturbations have been caused by these rod motions and fluid pressures. The analysis method accounts for these perturbations and is believed to be especially useful for shallow surface motor pumped well applications and installations where the sucker rod is not readily accessible, i.e., load cell installation would require a shutdown and disassembly of the pumping unit.

FIG. 1 shows a surface hydraulic pumping unit. The hydraulic pumping unit includes an actuator 2. In the preferred embodiment, the actuator 2 is essentially a cylinder (for containing pressurized fluid) and a piston (not shown) within the cylinder. Pressurized hydraulic fluid on the lower side of the piston supports the piston (and any attached devices) against downward acting forces such as the weight of the sucker rod, fluid column weight and other gravity induced forces. The pressurized hydraulic fluid is supplied to the hydraulic actuator 2 from the remainder of the surface hydraulic pumping unit, comprising a surface hydraulic pump 3 (or other source of pressurized fluid) through a control valve in controller 4, and a fluid conduit or flexible tubing 5. The fluid conduit 5 supplies pressurized hydraulic fluid to the piston shaft or rod side of the piston within the hydraulic actuator 2 to support and raise the piston. relieving or reducing the hydraulic fluid pressure lowers the piston. The tubing 5 shown may also be supplemented by other conduits between the controller 4 and hydraulic actuator 2, e.g., a second conduit for double acting motors and smaller drain or bleed conduits.

The surface hydraulic pump 3 is driven by an electric motor 6 having electric power supplied through an electric cable 7. The controller 4 preferably includes a pressurized fluid reservoir and one or more timed solenoid operated pilot valves and shift valves (not shown) to supply sufficient pressurized hydraulic fluid to actuate the piston in actuator 2 (and devices attached to the piston).

Alternative controls, actuators, and pump drivers can also be used in place of the timed solenoid valves, actuator 2 and the electric motor 6. Other pump drivers include natural gas or diesel engines. These engines can be supplied with fuel similar to the cable 7 supplying electric power to the electric motor. A rotating hydraulic motor can be an alternatives to the reciprocating hydraulic actuator or hydraulic motor 2. Alternative controllers can include a feedback type (e.g., sensing produced fluid), a feed-forward type, or use other means of control (other than electric power to a solenoid pilot valve).

The piston shaft is attached to the piston (not shown) within the hydraulic cylinder or actuator 2, and the piston shaft is also attached to a long sucker rod 8 within the well 10. The sucker rod 8 is composed of rod sections (e.g., a pony rod) connecting the hydraulic actuator 2 to a subsurface oil or other resource fluid pump 9 which is within a fluid resource or oil well 10. The oil well 10 generally extends from a ground surface 11 to near a subsurface resource (i.e., fluid reservoir) production zone 12. Although the resource pump 9 is shown near the well bottom, the resource pump 9 may be located at any depth within the well 10 as long as it is submerged sufficiently in the resource fluid to provide the resource pump 9 with a minimum net positive suction head.

The subsurface resource pump 9 is typically a conventional plunger or reciprocating fluid pump and check valve assembly, but may also be a centrifugal or other type of fluid pump. The plunger pump is actuated by the reciprocating motion of the sucker rod 8 driven by the hydraulic actuator 2 mounted on a wellhead at or near the ground (or other) surface 11.

The reciprocating rod 8 motions are cyclic and can be directly measured by a displacement transducer 13. The rod displacement transducer 13 may be a remotely sensing (through well head or tubing 17) type or direct rod contacting type (if the rod is isolated from the resource fluid). In the preferred embodiment, a rod rotator **2*a* (located at the top of the actuator 2 cylinder) actuates when the piston is at or near the top of the cylinder and is also used to determine rod location when the rotator is actuated. Displacement can be calculated by knowing the time the piston is fully extended (contacting the rod rotator 2*a***) and the stroke speed. If the speed is uniform, speed can be determined from known stroke length and time between rod rotator actuations. If speed is not uniform, upward stroke speed and downward stroke speed must be determined, for example by using the time the measured pressure indicates the bottom of piston travel. The determination assumes a constant or known stroke speed change with time.

Alternatively, rod displacement can be determined without any remote or direct measurements. The measured pressure can be used to detect top and bottom of stroke, e.g., a rapid change in pressure or a change in the rate of pressure change (i.e., a ramp rate change) at these points. The ramp rate detection of rod location and times is combined with stroke speed(s) to calculate displacement as above described.

Hydraulic fluid pressure is measured by a pressure transducer 14. Both measured hydraulic fluid pressure and rod location/times or displacements (if taken) over at least pumping cycle or cyclic period are transmitted to a data processor 15. The cyclic data may also be sampled periodically.

The data processor 15, if rod displacement must be determined, calculates displacement. Calculation may also be separate, e.g., manual stop watch timing the interval between rod rotator actuations, and input to the data processor 15. Pressure data is typically in analog form and supplied directly to the data processor 15.

The data processor 15 will typically have many other command inputs (e.g., keyboard entry of constants such as pump depth) and data inputs (e.g., resource fluid flow transducers), but these other inputs are not shown on FIG. 1 for clarity. The data processor 15 typically consists of a data or signal interface box (where all transducer signals are received by the data processor), an analog-to-digital signal converter, and a programmed microprocessor, such as a personal computer.

An air cooled heat exchanger 16 for cooling the pressurized hydraulic fluid is shown, but may not be required if the heat added (e.g., by the hydraulic pump) can be dissipated in the tubing 5 or elsewhere. After start-up, the hydraulic fluid is preferably maintained at from about 54.4 to 82.2° C. (130° to 180° F.). The hydraulic pump 3, controller 4, heat exchanger 16 and electric motor 6 may also be a single unit supplying many wells 10, each having a surface hydraulic motor 2.

The electric power is supplied through junction box 18. The junction box 18 is not required, but allows a safety temperature sensor 19 to interrupt power at the junction box 18 when the unit temperature exceeds a preset value.

It is to be understood that FIG. 1 is a schematic primarily of surface related equipment. Details and sizes, especially of subsurface equipment, are not intended to be representative. The diameter of well tubing 17 is theoretically unlimited, but nominal diameters ranging from about 4.22 to 8.89 cm. ($1\frac{2}{3}$ to $3\frac{1}{2}$ inches) are preferred, and nominal diameters ranging from 5.24 to 7.3 cm. (2 1/16 to $2\frac{7}{8}$ inches) are most preferred. The vertical depth and lateral offset, if any, of the resource pump 9 is also theoretically unlimited, but depths ranging from about 122 to 3048 meters (400 to 10,000 feet) are preferred and depths ranging from about 183 to 1524 meters (600 to 5,000 feet) are most preferred. Simulating "floating" rod motions are believed to be beneficial for applications having a minimum rod length (or depth for vertical wells) of at least 1.22 meters (400 feet).

In order to extrapolate to downhole conditions and simulate sucker rod 8 motions, a rod acceleration and force balance analysis is accomplished. The hydraulic fluid pressure can be used to calculate tensile forces (knowing piston area), rod stretch, and resulting resource fluid pressures, if rod properties are known or assumed.

The properties of the rod must be known or assumed and preferably with a range of values to maximize the accuracy of the performance analysis. Typical materials of construction (having known strength, stiffness and other properties) include polished steel, alloy steel, and fiberglass. Rods typically are composed of threadably attached long cylindrical sections having a solid cross-sectional diameter preferably ranging from about 1.27 to 3.18 cm ($\frac{1}{2}$ to $1\frac{1}{4}$ inch), more preferably from about 1.90 to 2.54 cm ($\frac{3}{4}$ to 1 inch), and still more preferably no more than 33 percent of the tubing diameter in order to minimize resource fluid flow. Plunger/rod stroke lengths are similarly theoretically unlimited, but stroke lengths are preferably limited to no more 426.7 cm (168 inches). Pumping cycle speeds are similarly theoretically unlimited, but typically range from about 3 to 10 cycles (or strokes) per minute.

The invention is further described by the following example which is illustrative of a specific mode of practicing the invention. The example is not intended as limiting the scope of the invention as defined by the appended claims.

EXAMPLE 1

The pumped well used for this example had a nominal $2\frac{7}{8}$ inch diameter tubing, a downhole pump set at a depth of 272 meters (894 feet) and a rod generally composed of steel and having a solid cross-sectional diameter of 1.9 cm ($\frac{3}{4}$ inch). Pumping speed was initially 8 strokes per minute (spm). Data processing (accomplished by data processor 15) received the data, converted analog to digital signals, and produced a pressure and rod displacement plot shown in FIG. 2.

The area within one cycle as shown can be used to calculate performance such as rod horsepower, pump efficiency, and resource fluid level. The calculated output indicated a pump efficiency of 25 percent when compared to the hydraulic pump energy input. The pumping speed was reduced to 6 spm and another dynamometer plot produced. The plot indicated a significant increase in pumping efficiency to approximately 80 percent.

The pressure and displacement plots output from the data processor 15 or other well and pump performance displays may also be normalized as previously discussed. Data gathering and display rates can be set by the user or a default rate value used. The display may also be in the form of strip charts or stored and compared to known performance displays.

A process flow chart is shown in FIG. 3. At step A, the pressure transducer 14 is installed on or near the hydraulic cylinder (actuator) 2 of the surface hydraulic pumping unit and the output signals connected to a data processor or data acquisition and processing unit 15. Data unit 15 includes data acquisition and processing capability, such as a microprocessor of personal computer. Other transducers and inputs, such as displacement motion inputs, may also installed and/or connected to the data acquisition and processing unit 15 at this time.

The hydraulic pumping unit is actuated and pressure and other data is gathered and processed at step B. Data gathering may require analog to digital conversion.

The downhole conditions are calculated at Step C, if required. In the preferred embodiment, calculations are performed by a computer program appended to this specification. The calculations model a sucker rod supported by hydraulic and resource fluids at both ends (i.e., "floating"). Sucker rod stretch, acceleration, and displacement can be calculated and used to normalize and extrapolate surface data to downhole conditions.

The calculated downhole conditions are output and compared to known performance patterns at step D. The surface data can also be displayed. The surface display is a plot of hydraulic pressure versus rod displacement. For shallow wells (and short sucker rods), the surface plot may be essentially the same as or easily extrapolated to downhole conditions. Output downhole conditions are in the form of a dynamometer plot of resource pressure versus displacement. Predicted pump and well performance can also be used for comparison, in addition of standard API dynamometer plots.

The calculating process may also require an iterative or equilibrium force analysis approach since the measured rod motions can be caused by (unknown) resource or (known) hydraulic fluid pressure changes. In the iterative approach, an initial estimate of resource fluid pressures acting on the rod 8 within the resource pump 9 is used in combination with other data to estimate sucker rod 8 motions, which motions are then used to calculate resource pressure caused by these motions. Calculated and initial estimates of resource pressure are compared and a new estimate (based upon calculated value) is made and subsequent steps repeated until the difference between estimated and calculated pressure is no longer significant. In the equilibrium approach, the displacement measurements are timed and rod accelerations/momentum changes are calculated. The momentum change and force balance on the rod/piston/-plunger assembly are used to calculate resource fluid pressures and well/pump performance.

If the well and/or pump operating performance is not acceptable, an operating condition, such as pump speed is changed. Hydraulic fluid pressure is again collected over at least one changed condition cycle and well-/pump performance calculated. The process is repeated until acceptable performance is achieved.

The invention satisfies the need to analyze and correct pumped well performance without the need to measure rod loads (as is currently required for sucker rod installations) or hydraulic fluid flow. The rod simulation deciphers previously extraneous perturbations in the data. Data displays can now be reliably correlated to known performance problems and solutions. During testing, the invention has been successful in identifying a pump efficiency problem and confirming that corrective actions taken had solved the inefficient pump operation problem.

The invention avoids shutting down an operating production well to install a load cell to obtain performance data. It also avoids direct access to the sucker rod, which is expected to improve safety. Performance analysis can now also be performed during workover, start-up, operational transients, partial load operations, and shutdown.

Still other alternative embodiments are possible. These include: attaching a motion or vibration damper to the long sucker rod 8 (e.g., a centralizer) and adding a vibration damper simulator to the data processing program; operating a series of surface hydraulic pumping units out of cyclic phase with each other from a central controller unit (to reduce the size of the hydraulic fluid reservoir in controller 4) and a multi-well simulator to the data processing program; adding a rod rotator simulator to the data processing program; adding a deviated well rod motion simulator to the data processing program; using the rod simulator and processing the data to remove extraneous rod motion/vibration indications, using known areas to convert hydraulic fluid pressure data to rod forces/loads, and producing API dynamometer card type plots for direct comparison to API standard indications; and processing the data to remove extraneous rod motion/vibration indications, using known areas to convert displacement motions into hydraulic fluid flow data, and producing data similar to subsurface motor installations for direct comparison.

Appended to this specification is a program listing. The program determines downhole conditions based primarily on hydraulic pressure. The program includes comments to aid in understanding.

While the preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. A method for determining a performance characteristic of a well producing a resource fluid and extending from at or near a ground surface to a subsurface depth wherein a pump is located within said well and said pump is attached to a rod driven by a hydraulic actuator located at or near said ground surface, said method comprising:

supplying pressurized actuating fluid to said actuator;

actuating said hydraulic actuator wherein said actuating causes a cyclic motion of said rod and a pumping of said resource fluid;

measuring said actuating fluid pressure during at least one cyclic motion; and calculating said performance characteristic based at least in part upon said measured actuating fluid pressure in the absence of a resource fluid pressure measurement and a rod force measurement.

2. The method of claim 1 wherein said cyclic motion is a reciprocating motion of said rod in a direction substantially parallel to the major dimension of said rod and wherein said cyclic motion has a frequency ranging from about 3 to 10 cycles per minute.

3. The method of claim 2 wherein said performance characteristic calculation is also based upon a displacement of said rod and said characteristic is a resource fluid pressure proximate to said pump.

4. The method of claim 3 wherein said calculating is based upon an iterative estimate of resource fluid pressure.

5. The method of claim 4 wherein said rod also comprises a motion damper attached to said rod and wherein said calculating is based upon a motion damper simulator.

6. The method of claim 5 wherein said rod also comprises a rod rotator for rotating said rod in a plane perpendicular to said reciprocating motion and wherein said calculating is based upon a rotator simulator.

7. An apparatus for determining a performance characteristic of a well and extending from a subsurface depth to proximate to a surface location, said apparatus comprising:

a subsurface pump for pumping a resource fluid located within said well;

a rod attached to said pump and extending from said subsurface pump to at or near said surface location;

a hydraulic actuator located proximate to said surface location and attached to said rod, wherein said actuator is capable of moving said rod in a cyclic motion and pumping said resource fluid;

a source of pressurized actuating fluid connected to said hydraulic actuator;

means for measuring the pressure of said actuating fluid; and means for calculating said performance characteristic based at least in part upon said measured pressure in the absence of a resource fluid pressure measurement and a rod force measurement.

8. The apparatus of claim 7 which also comprises:

means for measuring displacements of said cyclic motion; and wherein said performance characteristic calculation is also based upon said measured cyclic motion.

9. The apparatus of claim 8 wherein said depth is at least about 122 meters and said subsurface pump comprises a reciprocating plunger and check valve assembly.

10. The apparatus of claim 9 wherein said hydraulic motor comprises a cylindrical pressure vessel, piston and piston shaft attached to said piston and said rod, wherein said hydraulic motor produces a reciprocating motion.

11. The apparatus of claim 10 wherein said means for measuring pressure comprises a pressure transducer located proximate to said hydraulic actuator.

12. The apparatus of claim 11 wherein said means for measuring displacement motion comprises a remote sensing rod displacement transducer.

13. The apparatus of claim 11 wherein said means for measuring displacement comprises means for indicating when the piston reaches a position within said cyclic motion and timing means for timing an interval between subsequent indications.

14. The apparatus of claim 13 wherein said means for calculating is also capable of calculating said measured displacement speed from said piston position and timing interval.

15. The apparatus of claim 14 wherein said source of actuating fluid comprises a hydraulic fluid controller, hydraulic fluid reservoir and hydraulic fluid pump.

16. The apparatus of claim 15 wherein said hydraulic fluid pump is driven by an electric motor.

17. The apparatus of claim 16 which also comprises a motion damper attached to said rod and said calculating is based upon a motion damper simulator program.

18. The apparatus of claim 17 which also comprises a rod rotator for rotating said rod in a plane perpendicular to said reciprocating motion and wherein said calculating is based upon a rotator simulator program.

19. The apparatus of claim 11 wherein said means for measuring displacement comprises a means for measuring pressure ramp rate at a time within said cyclic motion.

20. A method for determining the performance of a downhole pump within a resource fluid producing well and said pump is attached to a rod driven by a fluid actuator located at or near a ground surface, said method comprising:

supplying pressurized actuating fluid to said actuator;

actuating said actuator wherein said actuating causes a cyclic motion of said rod;

measuring said actuating fluid pressure during at least one cyclic motion; and calculating said performance based at least in part upon said measured actuating fluid pressure and a calculated resource pressure, said calculating in the absence of a rod force measurement.

21. The method of claim 20 wherein said calculating is also based upon a floating rod simulation model.

22. The method of claim 21 wherein said rod simulation program calculates rod stretch, acceleration and fluid force balance.

23. The method of claim 21 wherein said calculating is based upon an iterative estimate of resource fluid pressure.

* * * * *

UNITED STATES PATENT AND TRADEMARK OFFICE

CERTIFICATE OF CORRECTION

PATENT NO. : 5,184,507

DATED : February 9, 1993

INVENTOR(S) : Charles L. Drake

It is certified that error appears in the above-identified patent and that said Letters Patent is hereby corrected as shown below:

Claim 8, column 9, line 16, delete "displacements" and insert therefor -- displacement --.

Claim 10, column 9, lines 25 and 27, both occurrences, delete "motor" and insert therefor -- actuator --.

Signed and Sealed this

Sixteenth Day of November, 1993

Bruce Lehman

*Attest:*

BRUCE LEHMAN

*Attesting Officer*

*Commissioner of Patents and Trademarks*